US010888140B1

(12) United States Patent
Fildan et al.

(10) Patent No.: US 10,888,140 B1
(45) Date of Patent: Jan. 12, 2021

(54) FLEXIBLE FASTENER FOR TEXTILES

(71) Applicants: Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: Dubrosky & Tracy Patent Service Corp., Central (HK)

( * ) Notice: Subject to any disclaimer, the term of this patent is extended or adjusted under 35 U.S.C. 154(b) by 0 days.

(21) Appl. No.: 16/722,019

(22) Filed: Dec. 20, 2019

(51) Int. Cl.
*A44B 18/00* (2006.01)
*A41F 1/00* (2006.01)

(52) U.S. Cl.
CPC ..... *A44B 18/008* (2013.01); *A41F 1/00* (2013.01)

(58) Field of Classification Search
CPC ..... A44B 18/008; A41F 1/00
See application file for complete search history.

(56) References Cited

U.S. PATENT DOCUMENTS 3,685,105 A * 8/1972 Carlile ..... A44B 17/0029 24/689
4,183,121 A * 1/1980 Cousins ..... A44B 13/0023 24/588.1
6,202,260 B1 3/2001 Clune et al.
6,393,678 B1 5/2002 Fildan et al.
7,246,416 B2 7/2007 Duffy
8,869,358 B2 10/2014 Wanzenboeck et al.
9,943,121 B2 * 4/2018 Gellineau ..... A41D 1/002
2002/0010986 A1 * 1/2002 Fildan ..... A41C 3/00 24/689
2005/0251970 A1 * 11/2005 Fildan ..... A41F 1/006 24/114.05
2012/0174346 A1 * 7/2012 Fildan ..... A41F 1/002 24/303

FOREIGN PATENT DOCUMENTS

WO 2013052742 A1 4/2013

* cited by examiner

*Primary Examiner* — Robert Sandy
*Assistant Examiner* — David M Upchurch
(74) *Attorney, Agent, or Firm* — Kintner IP, LLC; Mary Frances Ludwig

(57) ABSTRACT

A flexible fastener includes a plurality of arrays of studs engaged with complimentary arrays of rings. The studs of each array are connected to diagonally adjacent studs via arms adjoining the stem of the stud. Interstitial recesses defined by the arms and stems are sized and configured to engage with the heads of studs on an engaging fastener piece. In embodiments, the fastener provides high tensile strength, continuous adjustment in two directions, and improved comfort when used in a garment. In some embodiments the fastener includes features which ensure alignment between pieces.

17 Claims, 7 Drawing Sheets

FLEXIBLE FASTENER FOR TEXTILES

CROSS REFERENCE TO RELATED APPLICATION

None

TECHNICAL FIELD

The present invention pertains generally to fasteners, and more particularly to a flexible fastener for textiles.

BACKGROUND OF THE INVENTION

Fasteners for securing textiles, for example the back strap of a brassiere, lingerie, swimwear or the like, must be capable of withstanding significant tension while also being flexible and comfortable. It is often advantageous for a fastener to be adjustable, such as to vary the length of a garment strap to suit a wearer. It would also be advantageous for such a fastener to provide alignment of pieces to be fastened together.

Hook and loop fasteners are commonly used when flexibility and adjustability are required. However, these fasteners may not resist the high tensile stress of some applications. Furthermore, when opened the fastener may snag or damage delicate garments. In addition, such fasteners do not provide precise alignment of the pieces being joined.

BRIEF SUMMARY OF THE EMBODIMENTS

Embodiments disclosed herein are directed to a flexible fastener which provides high tensile strength, continuous adjustment in two directions, and improved comfort due to the fastener being relatively thin. When open, the fastener exposes only smooth or curved surfaces which will not catch or snag on delicate garments. In some embodiments the fastener includes features which ensure alignment between pieces.

According to one or more embodiments, a flexible fastener for textiles includes:

a plurality of arrays of studs, each stud having a head connected to a stem, within each array of studs every stud being connected to at least one diagonally adjacent stud via an arm adjoining the stem, each array of studs having interstitial recesses defined by the arms and stems;

each array of studs engaged with a complimentary array of rings, each ring having an aperture;

a first carrier piece supporting more than one of the plurality of arrays of studs, the stem of each supported stud protruding through the first carrier piece and through an aperture of one ring of the arrays of rings engaged therewith, the arrays of studs and the arrays of rings being joined together with the heads of the studs and the interstitial recesses exposed on a front face of the first carrier piece and the first carrier piece sandwiched between the supported studs and the rings engaged therewith;

a second carrier piece supporting at least one of the plurality of arrays of studs the stem of each supported stud protruding through the second carrier piece and through an aperture of one ring of the at least one array of rings engaged therewith, the at least one array of studs and the at least one array of rings being joined together with the heads of the studs and the interstitial recesses exposed on a front face of the second carrier piece and the second carrier piece sandwiched between the at least one array of studs and the at least one array of ring engaged therewith; and wherein the heads of studs supported on the second carrier piece are configured for engagement with the interstitial recesses on the front face of the first carrier piece.

According to one or more embodiments, the first carrier piece has partially bounded recesses between adjacent arrays of studs, and the partially bounded recesses are shaped and dimensioned for engagement with the array of studs supported on the second carrier piece. This feature ensures the arrays of studs on the first carrier piece are arranged with a spacing that may engage with the second carrier piece, thereby providing continuous adjustability of the fastener.

According to one or more embodiments, the engagement of the second carrier piece with the first carrier piece is adjustable in at least one dimension along the front face of the first carrier piece. According to some of these embodiments, the engagement of the second carrier piece with the first carrier piece is adjustable in two dimensions along the front face of the first carrier piece.

According to one or more embodiments, the interstitial recesses of the arrays of studs have a maximum recess dimension in a forwardmost plane which is smaller than a maximum head dimension of the heads. This feature provides a tight snap or press fit between the head of the studs and interstitial recesses.

According to one or more embodiments, the interstitial recesses have an inner dimension which is larger than the maximum head dimension. This features provides room for the heads to move within the recesses without disengaging when the fastener is under tension.

According to one or more embodiments, the head of each stud has a front tapered surface which tapers to a maximum head dimension. This feature facilitates engagement of the head in the smaller recess opening.

According to one or more embodiments, the head of each stud has a rear surface which tapers away from a maximum head dimension toward the stem. In some embodiments, the rear surface tapers toward the stem at an angle of about 45 degrees. In other embodiments, the head of each stud has a rear surface which is substantially level between a plane of maximum head dimension and the stem. This feature resists disengagement, and provides a permanent fastener connection.

According to one or more embodiments, the arrays of studs have heads aligned on a series of curves having a shared radius of curvature. This feature prevents misalignment of the fastener pieces, as arrays will not interlock if they do not share the center of curvature. In some embodiments, the radius of curvature is between 10 times and 15 times larger than a maximum head dimension of the heads.

According to one or more embodiments, the studs are mushroom-shaped.

According to one or more embodiments, the fastener resists disengagement under a tensile stress of at least 8 kg.

According to one or more embodiments, the thickness from a front face of the array of studs to a rear face of an array of rings engaged with the array of studs is 4 mm or less.

Further provided is a garment including the flexible fastener according to any of the above embodiments.

According to one or more embodiments, a flexible fastener includes:

a plurality of arrays of studs, each stud having a head connected to a stem, within each array of studs every stud being connected to at least one diagonally adjacent stud via an arm adjoining the stem, each array of studs having interstitial recesses defined by the arms and stems;

each array of studs engaged with a complimentary array of rings, each ring having an aperture;

the stem of each stud protruding through an aperture of one ring of the arrays of rings engaged therewith, the arrays of studs and the arrays of rings being joined together with the heads of the studs and the interstitial recesses exposed on a front face of the fastener; and wherein the heads of a first array of studs are configured for engagement with the interstitial recesses on the front face of a second array of studs.

These and other aspects of the embodiments will be better appreciated and understood when considered in conjunction with the following description and the accompanying drawings. The following description, while indicating various embodiments and details thereof, is given by way of illustration and not of limitation. Many substitutions, modifications, additions, or rearrangements may be made within the scope of the embodiments, and the embodiments may include all such substitutions, modifications, additions, or rearrangements.

BRIEF DESCRIPTION OF THE DRAWINGS

Non-limiting and non-exhaustive embodiments of the flexible fastener are described with reference to the following figures, wherein like reference numerals refer to like parts throughout the various views unless otherwise specified.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of these various embodiments.

DETAILED DESCRIPTION OF THE INVENTION

Figure 1:
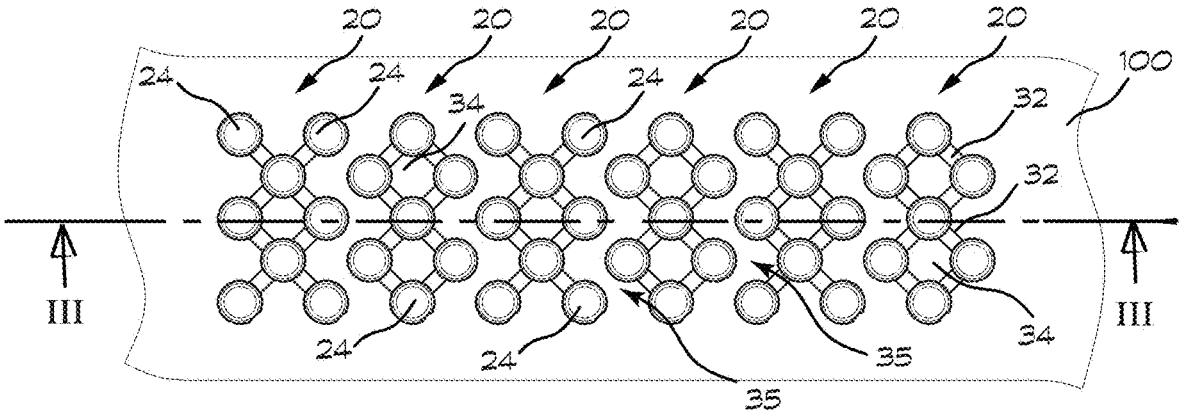
FIG. 1 is a front elevation view of an embodiment of a flexible fastener.
Figure 2:
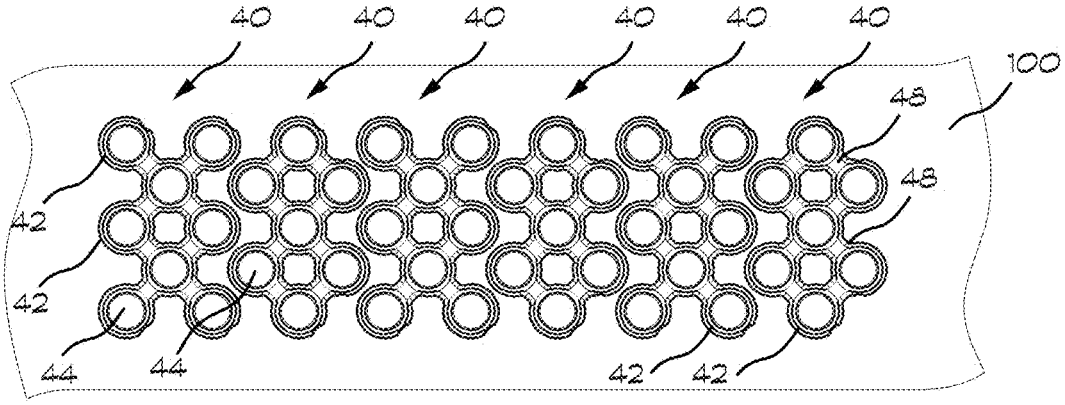
FIG. 2 is a rear elevation view of the FIG. 1 embodiment.
Figure 3:
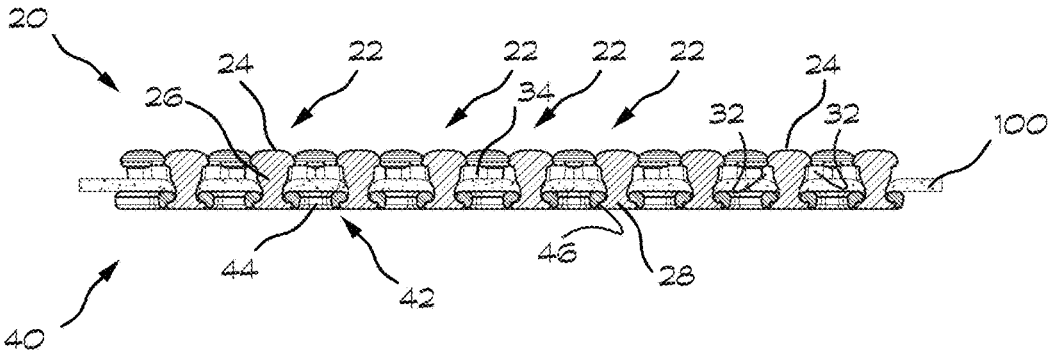
FIG. 3 is a cross-sectional view along line III-III of FIG. 2.

Referring initially to FIGS. 1-3, there are illustrated front and rear elevation and cross-sectional views, respectively, of an embodiment of a flexible fastener for textiles. The shown embodiment of the flexible fastener includes multiple arrays of studs 20 each engaged with a complementary array of rings 40 with a carrier piece 100 sandwiched between the studs and the rings. Six arrays of studs 20 are shown engaged with six arrays of rings 40, although more or fewer arrays of studs and rings may be used as will be explained below. In the illustrated embodiment each array of studs and rings includes seven or eight studs 22 or rings 42, although again more or fewer may be used depending on the desired application. Carrier piece 100 may be a strip of fabric or other textile or flexible material, and may also be referred to herein as a tape.

Figure 12:
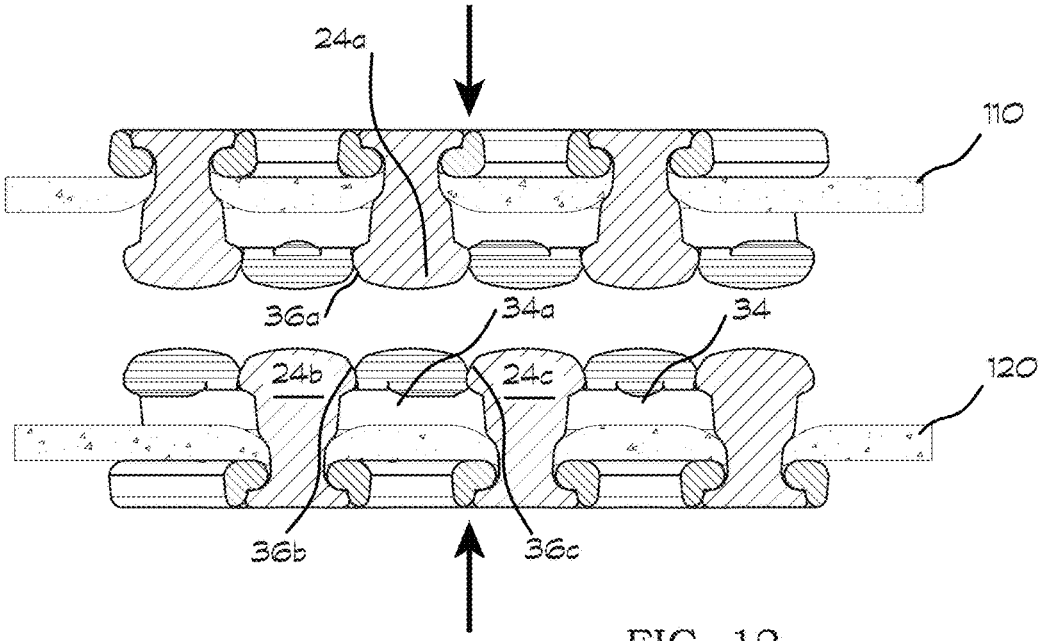
FIG. 12 is an enlarged cross-sectional view of an embodiment of the fastener in an open position.
Figure 13:
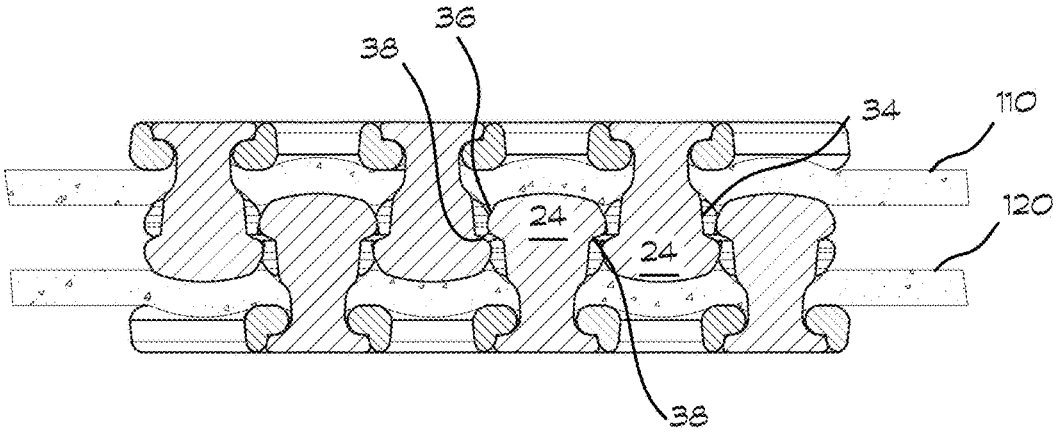
FIG. 13 is an enlarged cross-sectional view of the FIG. 12 embodiment in a closed position.

The front face of the fastener is the engaging face and each stud 22 has a head 24 exposed above tape 100. Referring also to FIGS. 12-13, the front face of a fastener on a first carrier piece 110 may engage with the front face of a fastener on a second carrier piece 120. Tapes 110 and 120 may carry identical arrays of studs which engage with one another. In some embodiments, a single tape may be folded upon itself so that some arrays of studs 20 engage with other arrays of studs 20 mounted on the same tape. This arrangement may be useful, for example, on an adjustable length strap.

Figure 4:
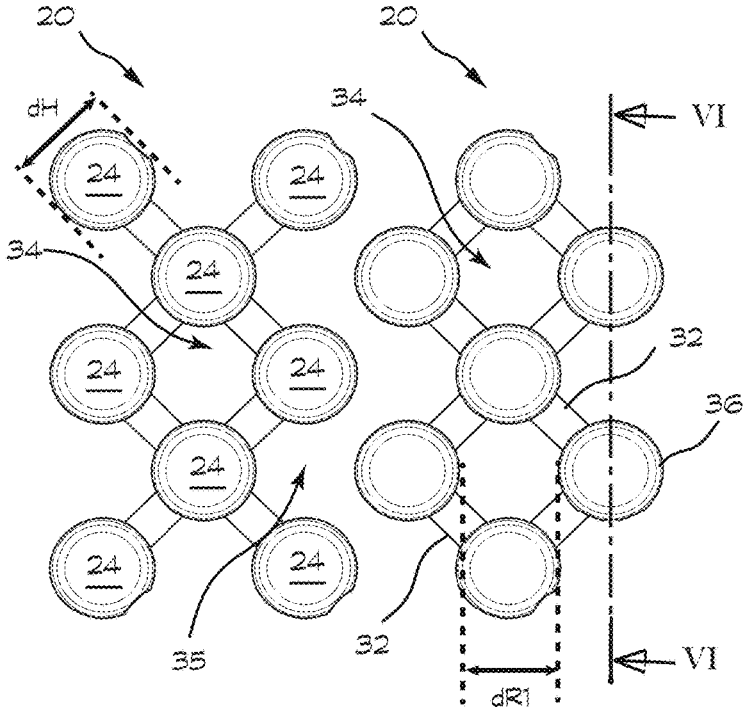
FIG. 4 is a front elevation view of an embodiment of two arrays of studs.
Figure 5:
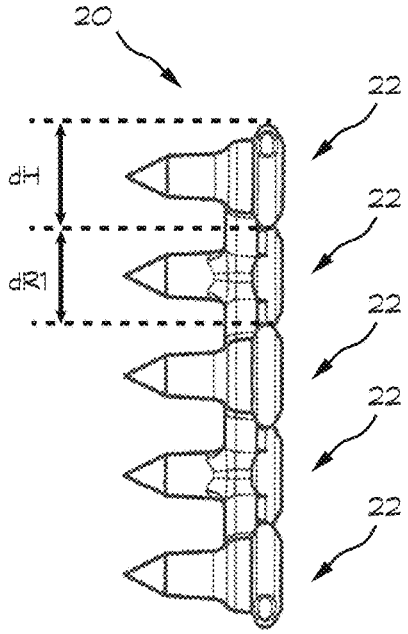
FIG. 5 is a side view of one array of studs of the FIG. 4 embodiment.
Figure 6:
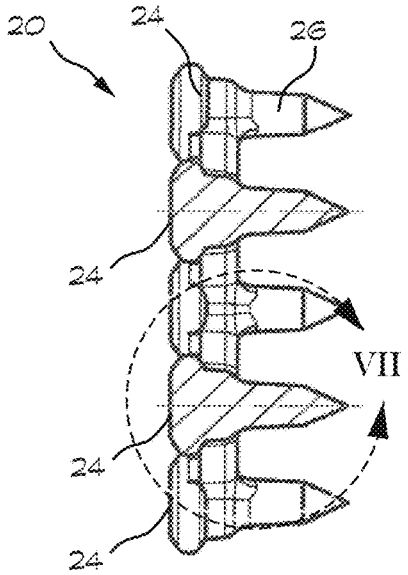
FIG. 6 is a cross-sectional view along line VI-VI of FIG. 4.
Figure 7:
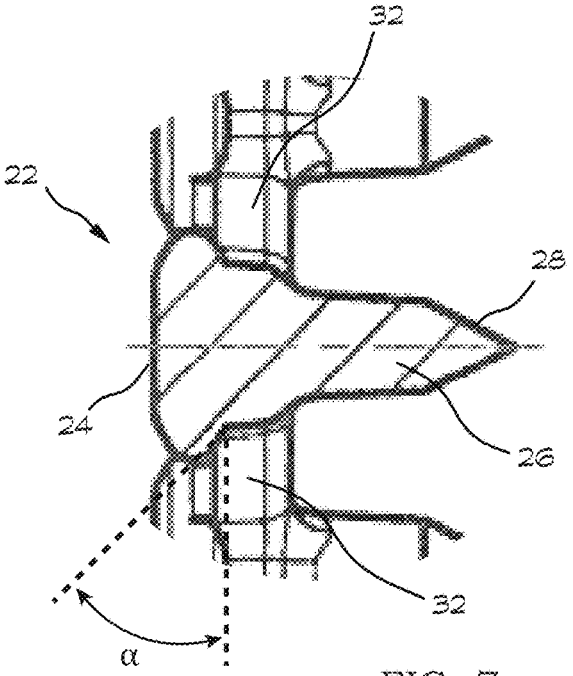
FIG. 7 is an enlarged view of area VII of FIG. 6.

FIGS. 4-6 are, respectively, front, side, and cross-sectional views of an embodiment of arrays of studs 20. FIG. 7 is an enlarged view of a stud 22 in cross section. Each stud 22 has a head 24 connected to a stem 26. In embodiments stem 26 ends in a spike 28 configured to protrude through or penetrate the carrier tape.

Each stud 22 of an array of studs 20 is connected to at least one diagonally adjacent stud 22 by an arm 32. Arms 32 adjoin the stems 26 of connected studs, and are located below the heads 24 of the studs. In the assembled fastener, arms 32 are exposed on the front face of the tape (see FIG. 1). On the front face of the array of studs, arms 32 and stems 26 define interstitial recesses 34 sized to closely receive a head 24 of a stud when two fastener pieces are pressed together.

Figure 8:
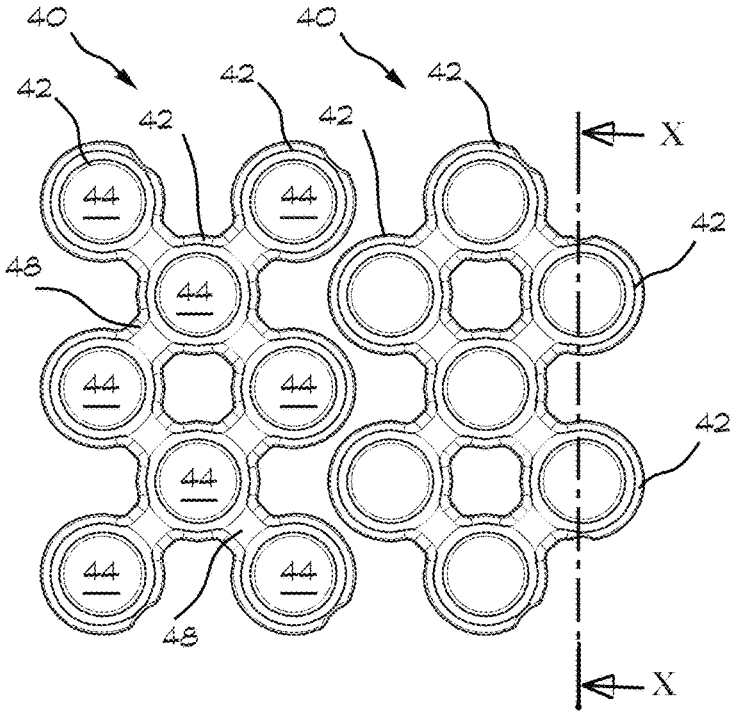
FIG. 8 is a rear elevation view of an embodiment of two arrays of rings.
Figure 9:
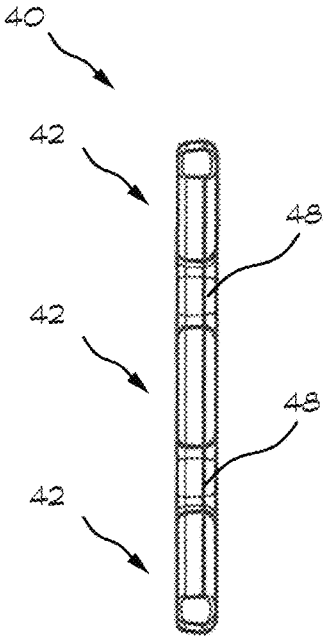
FIG. 9 is a side view of one array of rings of the FIG. 8 embodiment.
Figure 10:
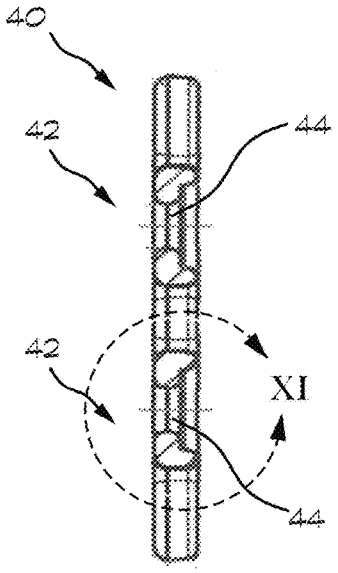
FIG. 10 is a cross-sectional view along line X-X of FIG. 8.
Figure 11:
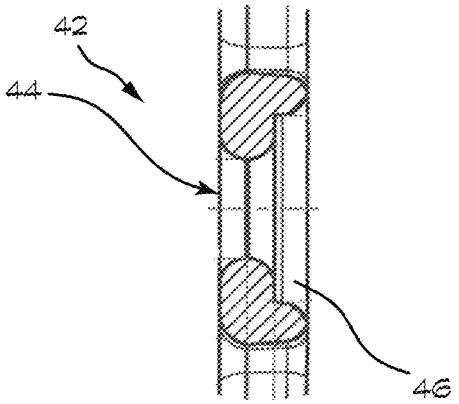
FIG. 11 is an enlarged view of area XI of FIG. 10.

FIGS. 8-10 are, respectively, rear, side, and cross-sectional views of an embodiment of arrays of rings 40 in a configuration complementary to the arrays of studs shown in FIGS. 4-6. FIG. 11 is an enlarged view of a ring 42 in cross section. Each ring 42 is configured for engagement with a stud 22 by protrusion of the stem 26 of the stud through an aperture 44 of the ring. Rings 42 may be interconnected by ring arms 48. Rings 42 may further have a well 46, or annular groove encircling aperture 44 on the rear face.

With reference to FIG. 3, in assembly, arrays of studs 20 are arranged on the front face of carrier piece 100 with the stem 26 of each stud protruding through the carrier piece, either through a preformed hole in the carrier or by pressure applied to force spike 28 through the carrier material. Arrays of rings are located on the opposing side of the carrier tape from heads 24, and stems 26 protrude through apertures 44 of the rings. Carrier tape is thereby sandwiched between the arrays of studs 20 and arrays of rings 40. When ring 42 is assembled with a stud 22, for example via ultrasonic welding, well 46 may contain any the welded material from spike 28 of the stud.

Referring again to FIGS. 12-14 there are shown enlarged cross-sectional views, respectively, of an embodiment of the fastener in an open position, a closed position, and the closed position when under tension. The shown embodiment includes a first carrier piece 110 and a second carrier piece 120. In the open position of FIG. 12, heads 24 are aligned with recesses 34 and will be connected when pressure is applied in the direction of the arrows. Each head has a front tapered surface 36, which tapers to a maximum head dimension (here, the diameter) of the mushroom-shaped head. Front tapered surfaces 36 promote engagement of the fastener. As shown most clearly in FIG. 12, surface 36*a* of one head 24*a* is easily passed by surfaces 36*b*, 36*c* of heads 24*b* and 24*c* which surround the engaging recess 34*a*.

Each head has a rear surface 38, which in some embodiments tapers downwardly toward the stem away from the maximum head dimension. Such tapered surfaces promote disengagement of the fastener, by enabling rear surfaces 38 to pass by one another when a force is applied to separate pieces 110, 120, in a manner opposite the manner of engagement described above. Rear surfaces 38 form an angle $\alpha$ between the annular of maximum head dimension and stem 26 (see FIG. 7). In the shown embodiment, angle $\alpha$ is about 45°. In other embodiments, angle $\alpha$ may be between 30° and 60°.

Figure 15:
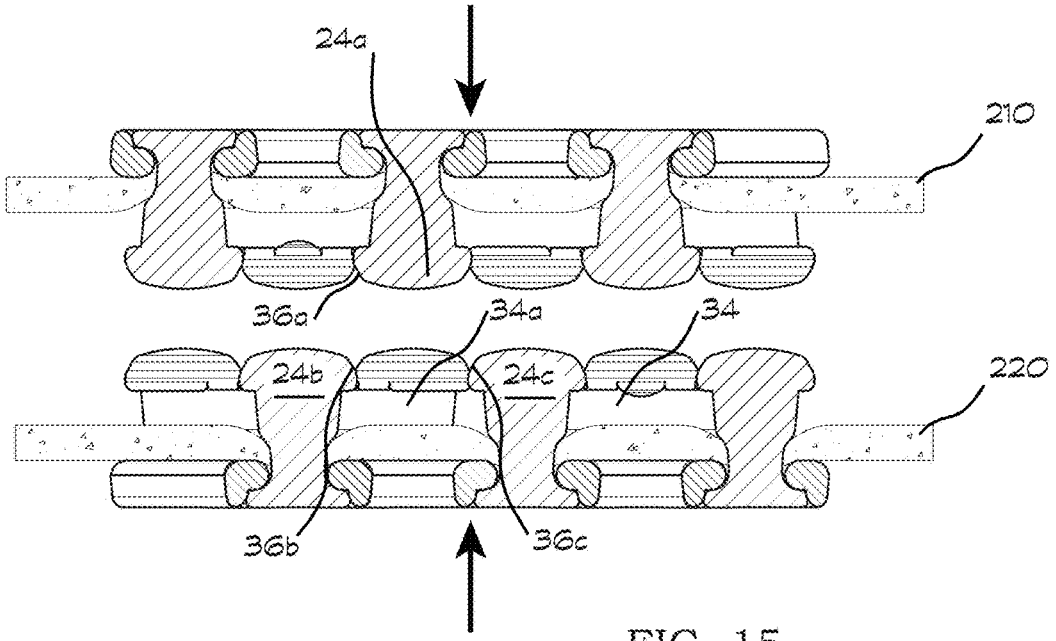
FIG. 15 is an enlarged cross-sectional view of another embodiment of the fastener in an open position.
Figure 16:
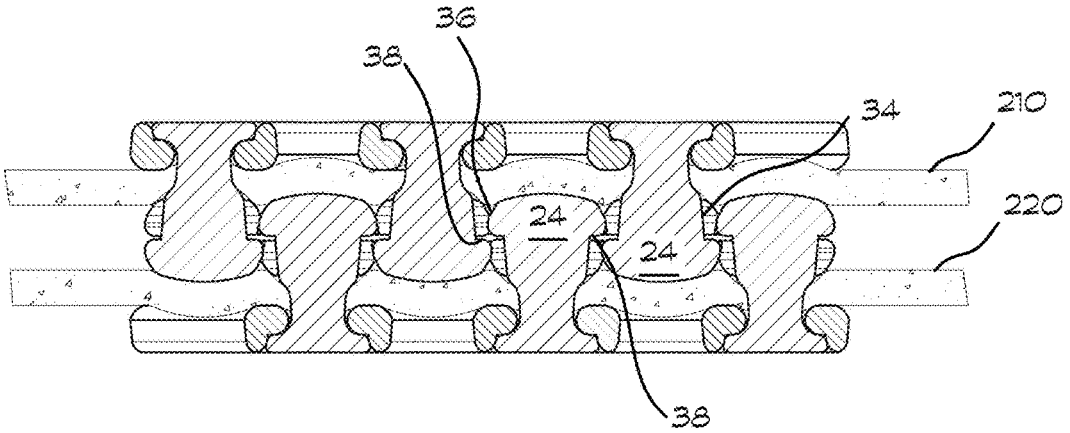
FIG. 16 is an enlarged cross-sectional view of the FIG. 15 embodiment in a closed position.
Figure 17:
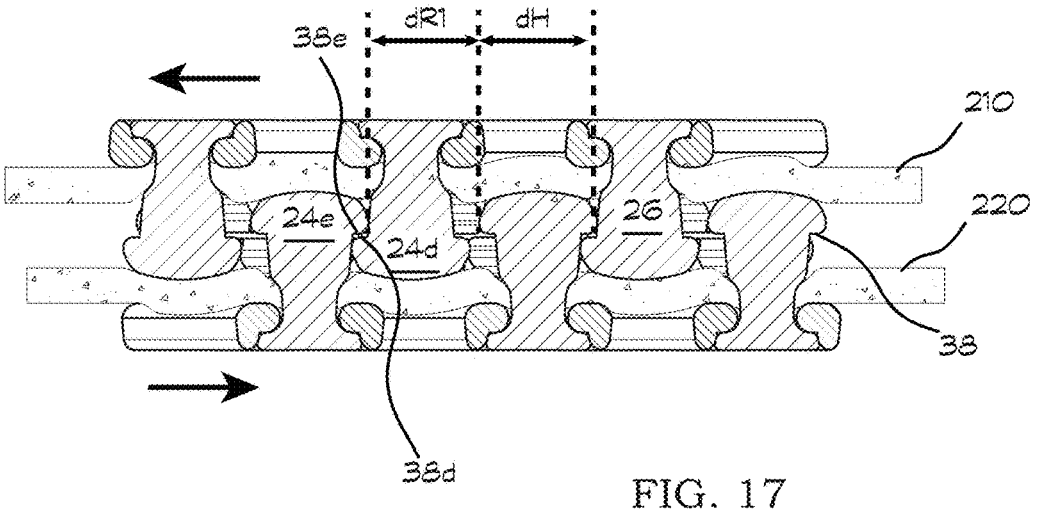
FIG. 17 is an enlarged cross-sectional view of the FIG. 15 embodiment in a closed position under tension.

FIGS. 15-17 are enlarged cross-sectional views of another embodiment of the fastener in the open position, the closed position, and the closed position when under tension. In the shown embodiment, rear surfaces 38 of the head are substantially level between the maximum head diameter and top of stem 26. This arrangement of rear surfaces 38 resists disengagement of the fastener, and is useful when permanent attachment is desired such as when connecting a panel or sheet to a garment.

As may be seen clearly with reference to FIG. 16, when rear surfaces 38 are level or flat in extension between the largest part of the head to the stem, interference between interlocked heads 24 is greater than in the alternative embodiment of FIG. 13 where rear surfaces are tapered downwardly. A higher force would therefore be required to disengage pieces 210, 220 of the fastener shown in FIG. 16.

Referring again to FIGS. 4 & 5, in some embodiments the maximum head dimension, dH, of the head 24 of each stud is slightly smaller than the maximum recess dimension, dR1, measured in the forwardmost plane of the recesses 34 (maximum here referring to the maximum dimension available in the forwardmost plane of the recess; measurements at other points within the recess may have larger dimensions). For example, dH may be 2.4 mm while dR1 may be 2.3 mm (in the shown case dH is the maximum diameter of the head as measured in the plane of engagement with the recess). This arrangement ensures that engagement of heads of a first piece with recesses of a second piece must occur under applied pressure, similar to a snap fastener. Advantageously, disengagement requires an applied force in the opposite direction of engagement.

Figure 14:
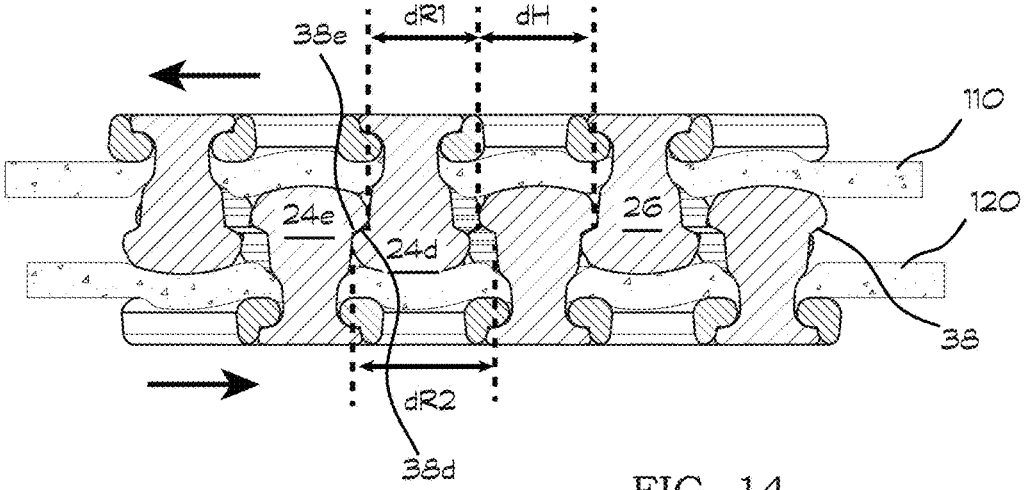
FIG. 14 is an enlarged cross-sectional view of the FIG. 12 embodiment in a closed position under tension.

Referring also to FIGS. 14 and 17, the tapering of rear surfaces 38 of each head toward the more narrow stem 26 provides a region of the interstitial recesses having an inner dimension dR2 which is larger than dH. Inner dimension dR2 is generally measured in a plane substantially parallel to and rearward of the forwardmost plane of the recess. For example, an interstitial recess may have an opening dR1 of 2.3 mm and a wider internal dimension dR2 of 2.9 mm. The additional space of the internal recess allows the engaged head 24 to shift without disengaging when the fastener is under tension (e.g., along directional arrows of FIGS. 14 & 17). When under tension, opposing heads 24*d*, 24*e* are forced toward each other and their respective rear surfaces 38*d*, 38*e* contact one another providing a catch feature which resists disengagement. In embodiments, the fastener can withstand a tensile stress of at least 8 kg (17.6 lbs) without disengaging.

Referring now to FIG. 1, arrays of studs 20 are spaced apart on carrier piece 100 such that the heads of adjacent arrays 20 are separated in the plane of arms 32 by a spacing substantially equal to the length of arms 32. In this manner adjacent arrays of studs form partially bounded recesses 35 which may engage the heads of studs on another carrier piece. These partially bounded recesses, or gaps, between arrays of studs allow the fastener to flex and bend, which is particularly useful for fasteners on garments such as sportswear and for other high stress applications.

Figure 18A:
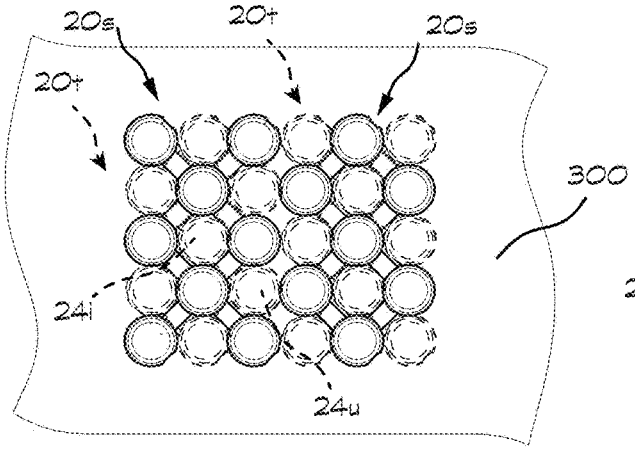
FIGS. 18A and 18B are front elevation views of an embodiment of a first carrier piece engaged with a second carrier piece in aligned and shifted configurations, respectively.
Figure 18B:
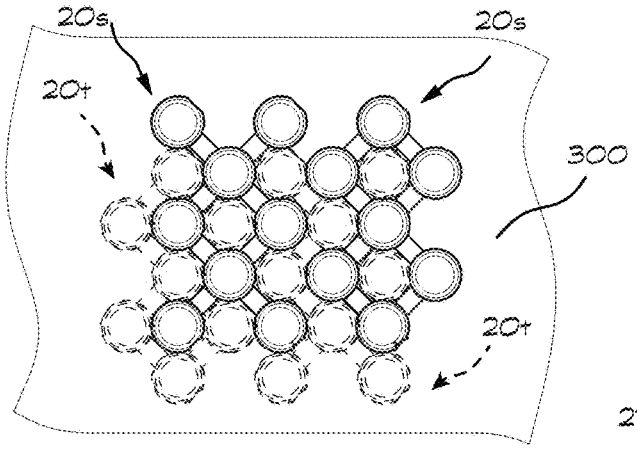

FIGS. 18A and 18B show arrays of studs 20*s* on a first carrier piece 300 engaged with arrays of studs 20*t* (shown in dashed lines) of a second carrier piece which is omitted for clarity. In FIG. 18A arrays 20*s* and 20*t* are shown aligned with one another in both the horizontal and vertical directions, without overhang or misalignment in either direction. Some heads 24*i* of arrays 20*t* are shown engaged in interstitial recesses 34 of arrays 20*s* while other heads 24*u* of arrays 20*t* are shown engaged in partially bounded recesses 35 between arrays 20*s* (refer also to FIG. 4).

In FIG. 18B arrays 20*t* are shown offset from arrays 20*s* by one row or column of heads in the horizontal and vertical directions, respectively. The grid pattern of heads and recesses allows for engagement of the fastener when the carrier pieces are shifted with respect to one another. This feature permits adjustment of the fastener, such as to change the length of a strap, and allows ease of fastening in cases where alignment is not critical, for example the closure of a pouch.

Figure 19:
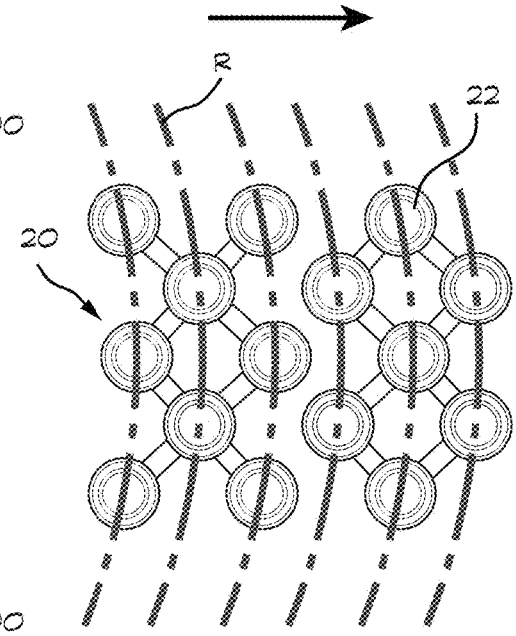
FIG. 19 is a front elevation view of another embodiment of an array of studs.

FIG. 19 is a front elevation view of another embodiment of arrays of studs 20. In this embodiment, studs 22 are arranged along a curve indicated by dot-dash line 'It' in the figure. This arrangement restricts adjustment of the fastener pieces to one dimension and forces alignment in the other dimension, as shown with reference to FIGS. 20A and 20B.

Figure 20A:
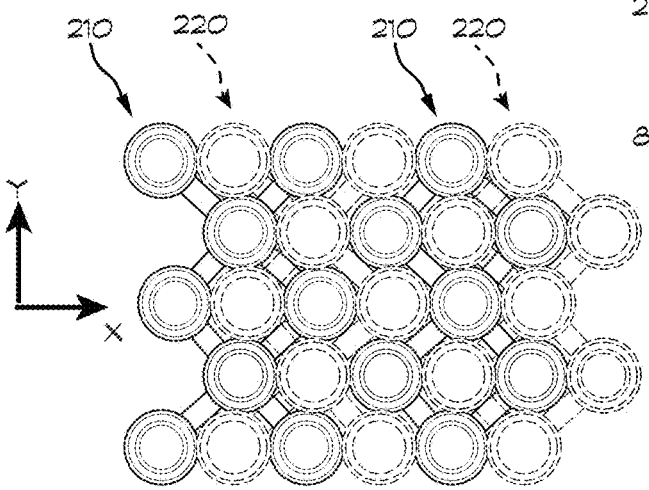
FIGS. 20A and 20B are front elevation views of another embodiment of a first carrier piece engaged with a second carrier piece in aligned and shifted configurations, respectively.

FIG. 20A shows arrays of studs 210 (mounted on a first carrier piece, omitted for clarity) engaged with identical arrays of studs 220 (shown in dashed lines and mounted on a second carrier piece also omitted from view). Arrays 210, 220 each have studs 22 arranged along curve R as seen in FIG. 19, the center of curvature in this case being along the X-axis. In FIG. 20A arrays 210 and 220 are shown aligned with one another in both the horizontal (X) and vertical (Y)

directions. Due to their matching curvature, arrays 210 and 220 are engagable, but may only be adjusted in one direction (X, in this case).

Figure 20B:
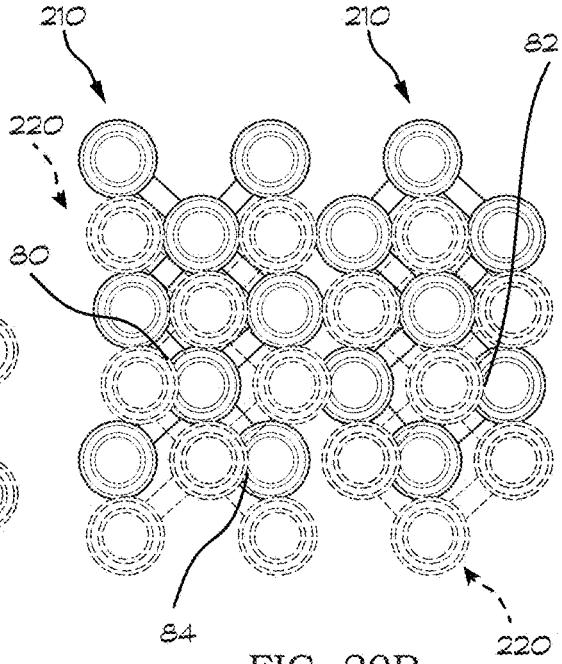

FIG. 20B shows arrays of studs 210, 220 where alignment has been shifted in the Y direction. In this configuration the arrays cannot engage with one another; note for example interference between heads at points 80, 82, 84, etc. In this way, the curvature R only allows the fastener to be engaged with a vertical orientation along Y as shown in FIG. 20A. Thus the curvature serves as a self-aligning feature, which may be of particular interest when fastening pieces that are small or difficult to align.

In addition, the curvature may increase the strength of the fastener if oriented along a direction of predicted tensile stress. For example, if the fastener of FIG. 19 were to be used on a brassiere back strap, it would be desirable to the orient the directional arrow toward the brassiere cups. In embodiments, the radius of curvature R may be 10-15 times larger than the maximum dimension of the heads 24.

Figure 21A:
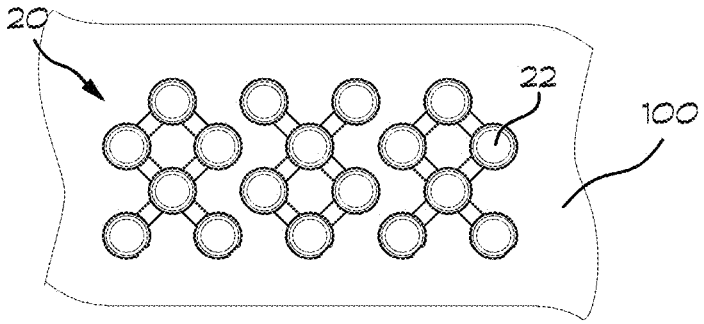
FIGS. 21A-21C are front elevation views of other embodiments of the fastener.
Figure 21B:
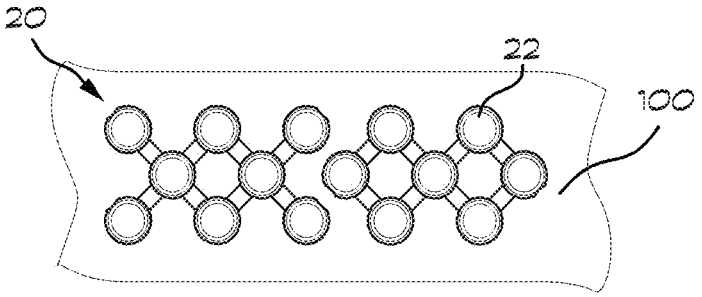
Figure 21C:
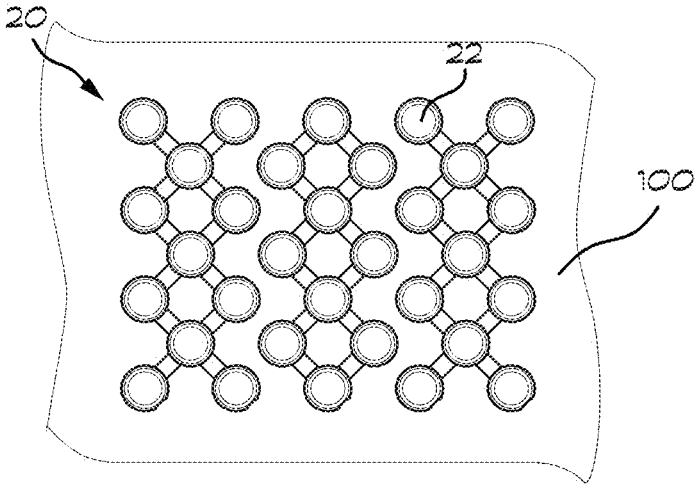

The arrays of studs 20 may be sized, shaped, or arranged differently than the shown embodiments, as may be desired for a particular application. The arrangement of FIG. 1 may be suitable when horizontal adjustment is desired, such as on a brassiere back strap. If the arrangement of FIG. 1 were oriented with a 90 degree rotation it may be suited for a vertically oriented fastener, such as a back of front closure for a garment top. FIGS. 21A-21C are front elevation views of other embodiments of the fastener. In FIG. 21A, the number of studs 22 in each array (six) is fewer than shown in FIG. 1 (seven or eight). This embodiment may be suitable for a small garment or a narrow strap. Likewise the embodiment of FIG. 21B may be desired for a narrow width textile application. The embodiment of FIG. 21C may be used where increased strength may be desired rather than high flexibility.

The arrays of studs 20 and arrays of rings 40 may be formed of a plastic material with suitable strength and flexibility, such as for example polyoxymethylene (POM) or polyamide (PA 6/6). The arrays 20, 40 may be manufactured by injection molding and may be joined together by ultrasonic welding. The first and second carrier pieces may be any textile; by way of non-limiting example the carrier pieces for a garment may be nylon fabric, tricot fabric, woven fabric, microfiber fabric, or a semi-elastic material laminated to tricot.

Further provided are a garment, a bag, an upholstery, a covering, or a decorative textile including a fastener in accordance with any of the embodiments described herein.

In other embodiments, arrays of studs and arrays of rings may be provided as a kit prior to being connected to a carrier strip. In other embodiments, arrays of studs and arrays of rings may be joined together and connected to a strip of double-sided adhesive tape.

As used in this application, the term "about" or "approximately" refers to a range of values within plus or minus 10% of the specified number. As used in this application, the term "substantially" means that the actual value is within about 10% of the actual desired value, particularly within about 5% of the actual desired value and especially within about 1% of the actual desired value of any variable, element or limit set forth herein.

The embodiments of the flexible fastener described herein are exemplary and numerous modifications, combinations, variations, and rearrangements can be readily envisioned to achieve an equivalent result, all of which are intended to be embraced within the scope of the appended claims. Further, nothing in the above-provided discussions of the flexible fastener should be construed as limiting the invention to a particular embodiment or combination of embodiments. The scope of the invention is defined by the appended claims.

What is claimed is:

1. A flexible fastener for textiles, the fastener comprising:

a plurality of arrays of studs, each stud having a head connected to a stem, within each array of studs every stud being connected to at least one diagonally adjacent stud via an arm adjoining the stem, each array of studs having interstitial recesses defined by the arms and stems;

each array of studs engaged with a complimentary array of rings, each ring having an aperture;

a first carrier piece supporting more than one of the plurality of arrays of studs, the stem of each supported stud protruding through the first carrier piece and through an aperture of one ring of the arrays of rings engaged therewith, the arrays of studs and the arrays of rings being joined together with the heads of the studs and the interstitial recesses exposed on a front face of the first carrier piece and the first carrier piece sandwiched between the supported studs and the rings engaged therewith;

a second carrier piece supporting at least one of the plurality of arrays of studs the stem of each supported stud protruding through the second carrier piece and through an aperture of one ring of the at least one array of rings engaged therewith, the at least one array of studs and the at least one array of rings being joined together with the heads of the studs and the interstitial recesses exposed on a front face of the second carrier piece and the second carrier piece sandwiched between the at least one array of studs and the at least one array of ring engaged therewith; and wherein the heads of studs supported on the second carrier piece are configured for engagement with the interstitial recesses on the front face of the first carrier piece.

2. The fastener of claim 1, wherein the first carrier piece has partially bounded recesses between adjacent arrays of studs, the partially bounded recesses shaped and dimensioned for engagement with the array of studs supported on the second carrier piece.

3. The fastener of claim 1, wherein the engagement of the second carrier piece with the first carrier piece is adjustable in at least one dimension along the front face of the first carrier piece.

4. The fastener of claim 3, wherein the engagement of the second carrier piece with the first carrier piece is adjustable in two dimensions along the front face of the first carrier piece.

5. The fastener of claim 1, wherein the interstitial recesses of the arrays of studs have a maximum recess dimension in a forwardmost plane which is smaller than a maximum head dimension of the heads.

6. The fastener of claim 5, wherein the interstitial recesses have an inner dimension which is larger than the maximum head dimension.

7. The fastener of claim 1, wherein the head of each stud has a front tapered surface which tapers to a maximum head dimension.

8. The fastener of claim 1, wherein the head of each stud has a rear surface which tapers away from a maximum head dimension toward the stem.

9. The fastener of claim 8, wherein the rear surface tapers toward the stem at an angle of about 45 degrees.

10. The fastener of claim 1, wherein the head of each stud has a rear surface which is substantially level between a plane of maximum head dimension and the stem.

11. The fastener of claim 1, wherein the arrays of studs have heads aligned on a series of curves having a shared radius of curvature.

12. The fastener of claim 11, wherein the radius of curvature is between 10 times and 15 times larger than a maximum head dimension of the heads.

13. The fastener of claim 1, wherein the studs are mushroom-shaped.

14. The fastener of claim 1, wherein the fastener resists disengagement under a tensile stress of at least 8 kg.

15. The fastener of claim 1, wherein the thickness from a front face of the array of studs to a rear face of an array of rings engaged with the array of studs is 4 mm or less.

16. A garment including the flexible fastener according to claim 1.

17. A flexible fastener comprising:

a plurality of arrays of studs, each stud having a head connected to a stem, within each array of studs every stud being connected to at least one diagonally adjacent stud via an arm adjoining the stem, each array of studs having interstitial recesses defined by the arms and stems;

each array of studs engaged with a complimentary array of rings, each ring having an aperture;

the stem of each stud protruding through an aperture of one ring of the arrays of rings engaged therewith, the arrays of studs and the arrays of rings being joined together with the heads of the studs and the interstitial recesses exposed on a front face of the fastener; and wherein the heads of a first array of studs are configured for engagement with the interstitial recesses on the front face of a second array of studs.

* * * * *